US009520096B2

(12) United States Patent
Asano et al.

(10) Patent No.: US 9,520,096 B2
(45) Date of Patent: Dec. 13, 2016

(54) LIQUID CRYSTAL DISPLAY DEVICE

(75) Inventors: Mitsuyasu Asano, Tokyo (JP); Tomohiro Nishi, Tokyo (JP)

(73) Assignee: SONY CORPORATION, Tokyo (JP)

( * ) Notice: Subject to any disclaimer, the term of this patent is extended or adjusted under 35 U.S.C. 154(b) by 784 days.

(21) Appl. No.: 13/026,596

(22) Filed: Feb. 14, 2011

(65) Prior Publication Data

US 2011/0234478 A1 Sep. 29, 2011

(30) Foreign Application Priority Data

Mar. 24, 2010 (JP) ..... 2010-068125

(51) Int. Cl.
*G09G 3/36* (2006.01)
*G09G 3/34* (2006.01)

(52) U.S. Cl.
CPC ..... *G09G 3/3648* (2013.01); *G09G 3/3426* (2013.01); *G09G 3/3655* (2013.01); *G09G 2320/0646* (2013.01); *G09G 2320/0686* (2013.01); *G09G 2360/16* (2013.01)

(58) Field of Classification Search
USPC ..... 345/87, 30, 46, 44
See application file for complete search history.

(56) References Cited

U.S. PATENT DOCUMENTS

2007/0126757 A1* 6/2007 Itoh et al. ..... 345/690
2008/0068359 A1* 3/2008 Yoshida et al. ..... 345/204
2010/0149085 A1* 6/2010 Kim et al. ..... 345/102
2011/0025731 A1* 2/2011 Hayashi ..... 345/690
2011/0037740 A1* 2/2011 Yamaguchi ..... 345/204
2011/0057967 A1* 3/2011 Adachi et al. ..... 345/690

FOREIGN PATENT DOCUMENTS

JP 2001-142409 5/2001
JP 2002-99250 4/2002
JP 2009-157400 7/2009

OTHER PUBLICATIONS

U.S. Appl. No. 13/016,138, filed Jan. 28, 2011, Asano, et al.
(Continued)

*Primary Examiner* — Amare Mengistu
*Assistant Examiner* — Shawna Stepp Jones
(74) *Attorney, Agent, or Firm* — Oblon, McClelland, Maier & Neustadt, L.L.P.

(57) ABSTRACT

A liquid crystal display device includes: a light source section so configured that independently-controllable emission subsections are formed on a light-exit plane of a light-guide plate; a liquid crystal display panel modulating, based on an input picture signal, light exited from each of the emission subsections in the light source section; and a display controlling section having a partitioning-drive processing section generating, based on the input picture signal, an emission pattern signal representing a light emission pattern of the emission subsections in the light source section, and a partitioning-drive picture signal. The display controlling section performs, based on the partitioning-drive picture signal, display-drive on each pixel in the liquid crystal display panel, and performs, based on the emission pattern signal, light-emission drive through allowing one or more of first light sources and one or more of second light sources to emit concurrently so as to form the emission subsections.

7 Claims, 15 Drawing Sheets

(56) References Cited

OTHER PUBLICATIONS

U.S. Appl. No. 13/074,617, filed Mar. 29, 2011, Asano, et al.
U.S. Appl. No. 13/070,965, filed Mar. 24, 2011, Asano, et al.
U.S. Appl. No. 13/082,809, filed Apr. 8, 2011, Asano, et al.
U.S. Appl. No. 13/095,104, filed Apr. 27, 2011, Asano, et al.
Chinese Office Action issued Jul. 2, 2014, in China Patent Application No. 201110068658.2 (with English translation).

* cited by examiner

LIQUID CRYSTAL DISPLAY DEVICE

CROSS REFERENCES TO RELATED APPLICATIONS

The present disclosure contains subject matter related to Japanese Patent Application JP 2010-068125 filed in the Japanese Patent Office on Mar. 24, 2010, the entire contents of which being incorporated herein by reference.

BACKGROUND

This disclosure relates to a liquid crystal display device provided with a light source section of a so-called edge-light type.

A liquid crystal display device or "LCD" of an active-matrix type, in which a thin-film transistor or "TFT" is provided for each pixel, has been often used in recent years as a display of a device such as a flat-screen television and a portable terminal. In general, the active-matrix liquid crystal display device line-sequentially writes a picture signal in an auxiliary capacitor and a liquid crystal element of each of the pixels from a top to a bottom of a screen to drive each of the pixels.

A backlight utilizing a cold-cathode fluorescent lamp (which may be hereinafter simply referred to as "CCFL") for a light source has been a mainstream backlight used in the liquid crystal display device. In recent years, however, a backlight utilizing a light-emitting diode (which may be hereinafter simply referred to as "LED") has been appearing, as disclosed in Japanese Unexamined Patent Application Publication No. 2009-157400, for example.

As for the liquid crystal display device in which the LEDs etc. are used as the backlight, Japanese Unexamined Patent Application Publication No. 2001-142409 proposes a configuration in which a light source section is partitioned into a plurality of emission subsections, and a light-emission operation or a "partitioned-emission operation" is independently performed on an emission subsection scale, for example.

SUMMARY

For a purpose of making a liquid crystal display device thinner as a whole, a backlight of a so-called edge-light type has been employed gradually in recent years, instead of a typical so-called direct backlight or an "overhead" backlight, as disclosed in Japanese Unexamined Patent Application Publication No. 2009-157400, for example. The edge-light backlight arranges light sources such as LEDs etc. on side faces of a light-guide plate, and is so configured that a light-exit plane is formed on the light-guide plate.

In general, the edge-light backlight is so designed as to prevent luminance non-uniformity in the light-exit plane from being generated as much as possible in a case where all of the light sources emit at the same light-emission intensity. Hence, in such case, display luminance non-uniformity is hardly generated on a display screen.

However, the inventor/the inventors has/have found that when an existing partitioned-emission operation in the currently-available direct backlight is applied as it is to the liquid crystal display device utilizing the edge-light backlight for a purpose of achieving, for example, lower power consumption and higher contrast, the following disadvantages are likely to occur.

One of the disadvantages is that when the existing partitioned-emission operation is performed in the edge-light backlight, a reduction of luminance corresponding to a distance from the light source is generated in the light-exit plane. For example, as compared with positions near the edges, the light-emission intensity is lower near the center of the light-exit plane that is located away from the light source. Also, the display luminance non-uniformity is generated in the display screen when such a reduction in the luminance corresponding to the distance from the light source is generated, thereby incurring a decrease in displaying quality.

It is desirable to provide a liquid crystal display device capable of increasing displaying quality in performing picture-displaying utilizing a light source section of an edge-light type in which a partitioned-emission operation is performed.

A liquid crystal display device according to an embodiment of the technology includes: a light source section including a light-guide plate having a light-exit plane partitioned into a plurality of emission subsections which are independently controllable of each other, a first pair of opposing side faces, and a second pair of opposing side faces, a plurality of first light sources disposed on one or both side faces of the first pair of opposing side faces of the light-guide plate, and a plurality of second light sources disposed on one or both side faces of the second pair of opposing side faces of the light-guide plate; a liquid crystal display panel including a plurality of pixels, and modulating, based on an input picture signal, light exited from each of the emission subsections in the light source section to perform picture-displaying; and a display controlling section having a partitioning-drive processing section generating an emission pattern signal and a partitioning-drive picture signal based on the input picture signal, in which the emission pattern signal represents a light emission pattern of the emission subsections in the light source section. The display controlling section performs, based on the emission pattern signal, light-emission drive on each of the light sources in the light source section, and performs, based on the partitioning-drive picture signal, display-drive on each of the pixels in the liquid crystal display panel. The display controlling section performs the light-emission drive through allowing one or more of the first light sources and one or more of the second light sources to emit concurrently so as to form the emission subsections.

In the liquid crystal display device according to the embodiment, the plurality of emission subsections, which are independently controllable of each other, are formed on the light-exit plane of the light source section by the plurality of first light sources, disposed on one or both side faces of the first pair of opposing side faces of the light-guide plate, and the plurality of second light sources, disposed on one or both side faces of the second pair of opposing side faces of the light-guide plate. In other words, the light source section has a configuration of an edge-light type capable of performing a partitioned-emission operation. Also, the emission pattern signal representing the light emission pattern of the emission subsections in the light source section, and the partitioning-drive picture signal are generated based on the input picture signal. Further, the light-emission drive is performed on each of the light sources in the light source section based on the emission pattern signal, and the display-drive is performed on each of the pixels in the liquid crystal display panel based on the partitioning-drive picture signal. Herein, the light-emission drive is so performed that one or more of the first light sources and one or more of the second light sources are allowed to emit concurrently so as to form the emission subsections. Thereby, reduction of luminance corresponding to distances from the light sources in the light-exit plane is reduced in the light source section of the edge-light type, as compared with an example where only a light source disposed on one side face corresponding to each emission subsection emits to form the emission subsections. As a result, display luminance non-uniformity in a display screen is suppressed.

According to the liquid crystal display device of the embodiment, the light-emission drive is so performed that one or more of the first light sources, disposed on one or both side faces of the first pair of opposing side faces of the light-guide plate, and one or more of the second light sources, disposed on one or both side faces of the second pair of opposing side faces of the light-guide plate, are allowed to emit concurrently so as to form the emission subsections, in performing the picture-displaying using the light source section of the edge-light type which performs the partitioned-emission operation. This makes it possible to reduce the reduction of luminance corresponding to the distances from the light sources in the light-exit plane, and to suppress the display luminance non-uniformity in the display screen. Therefore, it is possible to increase displaying quality in performing the picture-displaying utilizing the light source section of the edge-light type in which the partitioned-emission operation is performed.

It is to be understood that both the foregoing general description and the following detailed description are exemplary, and are intended to provide further explanation of the technology as claimed.

BRIEF DESCRIPTION OF THE DRAWINGS

The accompanying drawings are included to provide a further understanding of the technology, and are incorporated in and constitute a part of this specification. The drawings illustrate embodiments and, together with the specification, serve to explain the principles of the technology.

DETAILED DESCRIPTION

In the following, an embodiment of the technology will be described in detail with reference to the accompanying drawings. The description will be given in the following order.

1. Embodiment: an embodiment in which a first light source and a second light source, disposed respectively on side faces in different directions, emit concurrently to form an emission subsection in a backlight of an edge-light type.
2. Modification: a modification of the embodiment in which resolution-lowering signals are generated with taking into consideration both a pair of light sources on opposing side faces.
3. Other Modifications

EMBODIMENT

Overall Configuration of Liquid Crystal Display Device 1

Figure 1:
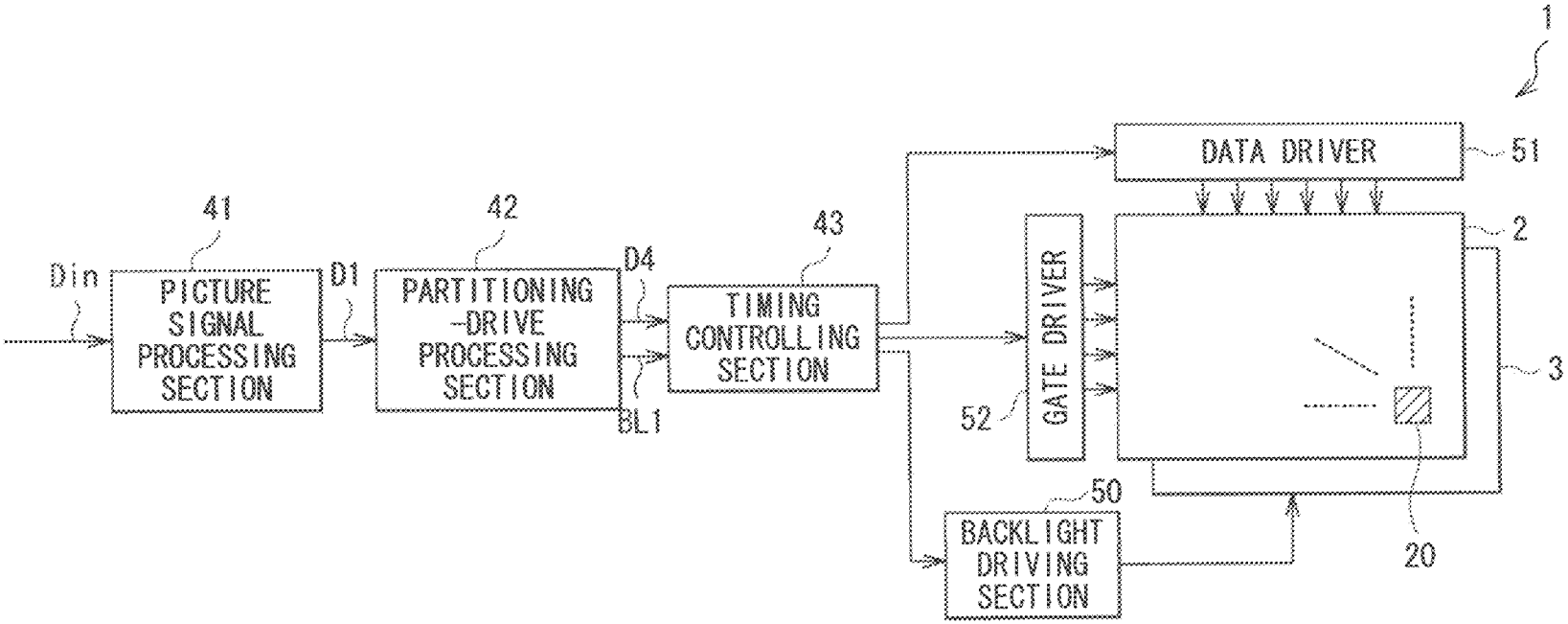
FIG. 1 is a block diagram illustrating an overall configuration of a liquid crystal display device according to an embodiment of the disclosure.

FIG. 1 illustrates a block configuration of a liquid crystal display device (a liquid crystal display device 1) as a whole according to an embodiment of the technology.

The liquid crystal display device 1 performs picture-displaying based on an input picture signal Din inputted from the outside. The input picture signal Din is a picture signal configured of a pixel signal of each pixel 20, which will be described later. The liquid crystal display device 1 is provided with a liquid crystal display panel 2, a backlight 3 serving as a light source section, a picture signal processing section 41, a partitioning-drive processing section 42, a timing controlling section 43, a backlight driving section 50, a data driver 51, and a gate driver 52. The picture signal processing section 41, the partitioning-drive processing section 42, the timing controlling section 43, the backlight driving section 50, the data driver 51, and the gate driver 52 correspond to an example of a "display controlling section" of the liquid crystal display device according to one embodiment.

The liquid crystal display panel 2 modulates, based on the input picture signal Din, light outputted from the later-described backlight 3 to thereby perform the picture-displaying based on the input picture signal Din. The liquid crystal display panel 2 includes the plurality of pixels 20 arranged in matrix as a whole.

Figure 2:
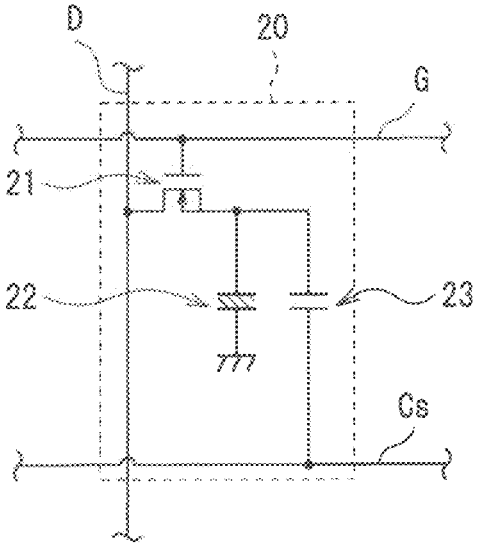
FIG. 2 is a circuit diagram illustrating an example of a detailed configuration of a pixel illustrated in FIG. 1.

FIG. 2 illustrates an example of a circuit configuration of a pixel circuit in each of the pixels 20. The pixel 20 is provided with a liquid crystal element 22, a TFT element 21, and an auxiliary capacitor 23. The pixel 20 is connected with: a gate line G for selecting, in a line-sequential fashion, a pixel to be driven; a data line D for supplying a picture voltage (a picture voltage supplied from the later-described data driver 51) to the pixel to be driven; and an auxiliary capacitance line Cs.

The liquid crystal element 22 performs a displaying operation in accordance with the picture voltage supplied to a first end thereof through the TFT element 21 from the data line D. The liquid crystal element 22 has a configuration in which a liquid crystal layer (not illustrated) is sandwiched by a pair of electrodes (not illustrated). The liquid crystal layer may be configured of liquid crystals of a vertical alignment (VA) mode, a twisted nematic (TN) mode, or other suitable mode, for example. One of the pair of electrodes (i.e., a first end) in the liquid crystal element 22 is connected to a drain of the TFT element 21 and to a first end of the auxiliary capacitor 23, whereas the other end of the pair of electrodes (i.e., a second end) thereof is grounded. The auxiliary capacitor 23 serves as a capacitor for stabilizing an accumulated charge in the liquid crystal element 22. The first end of the auxiliary capacitor 23 is connected to the first end of the liquid crystal element 22 and to the drain of the TFT element 21, whereas a second end thereof is connected to the auxiliary capacitance line Cs. The TFT element 21 serves as a switching element for supplying the picture voltage based on a picture signal D1 to the first end of the liquid crystal element 22 and to the first end of the auxiliary capacitor 23, and is configured by a metal oxide semiconductor-field effect transistor (MOS-FET). A gate of the TFT element 21 is connected to the gate line G, a source thereof is connected to the data line D, and the drain thereof is connected to the first end of the liquid crystal element 22 and to the first end of the auxiliary capacitor 23.

[Backlight 3]

The backlight 3 serves as the light source section for irradiating light to the liquid crystal display panel 2. The backlight 3 includes a light-emitting element (or a light source), which may be a CCFL, an LED, or other suitable light emitter. As will be described later in detail, the backlight 3 is so configured that light-emission drive corresponding to contents of the input picture signal Din (i.e., a picture pattern) is performed.

Figure 3A:
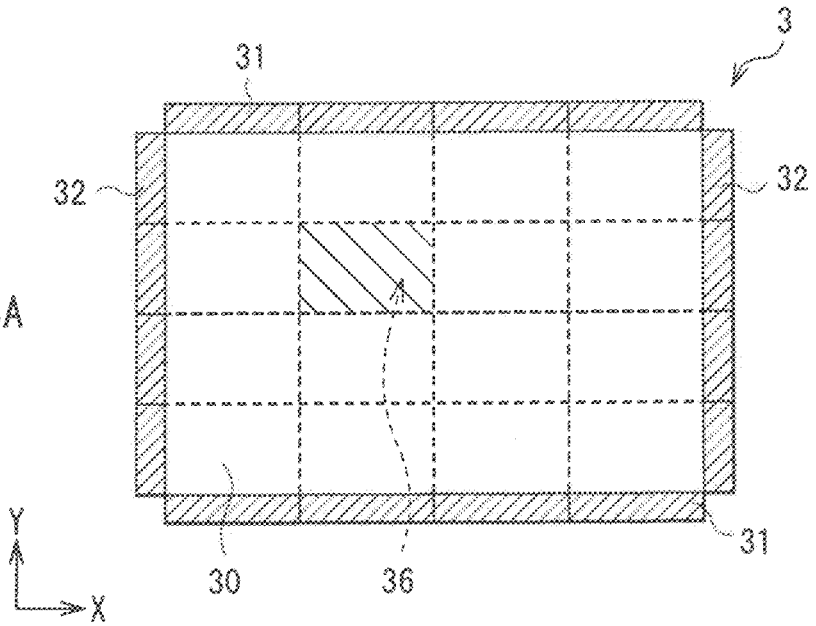
FIGS. 3A and 3B are plan views schematically illustrating a detailed configuration of a backlight illustrated in FIG. 1.
Figure 3B:
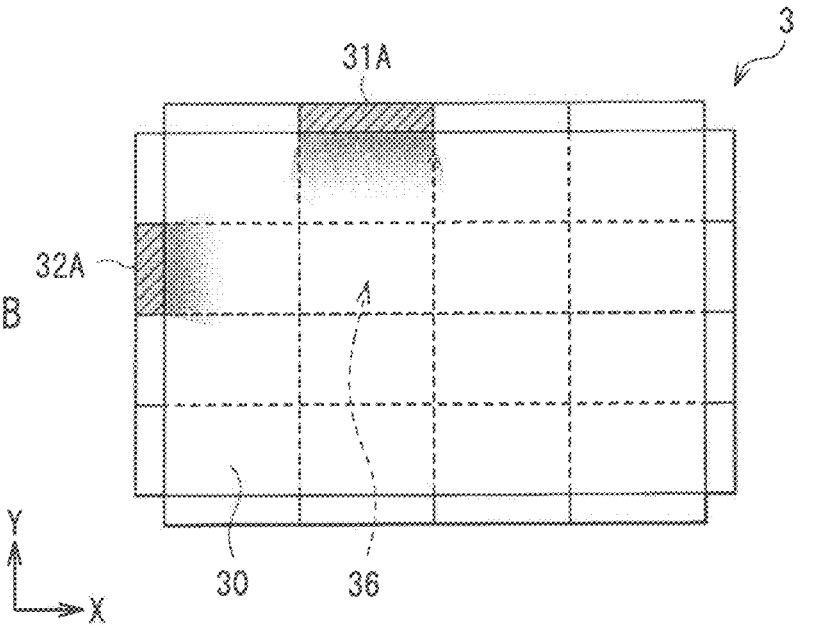

FIGS. 3A and 3B are plan views schematically illustrating a detailed configuration of the backlight 3. The backlight 3 includes: a light-guide member 30 (hereinafter referred to as a "light-guide plate 30", although a light-guide sheet may be employed in one embodiment) for forming a light-exit plane; and a plurality of light sources 31 (first light sources) and 32 (second light sources) arranged on side faces (side faces of the light-exit plane) of the light-guide plate 30. The light-guide plate 30 may be rectangular in shape, although it is not limited thereto. In one embodiment illustrated in FIGS. 3A and 3B, the plurality of light sources 31 (four in this embodiment, although it is not limited thereto) are disposed on each side of a pair of side faces extending in an X-axis direction (i.e., the side faces in a vertical direction), within two pairs of side faces (i.e., the side faces in vertical and horizontal directions) in the rectangular light-guide plate 30 which are opposed. Also, the plurality of light sources 32 (four in this embodiment, although it is not limited thereto) are disposed on each side of a pair of side faces extending in a Y-axis direction (i.e., the side faces in the horizontal direction) within the two pairs of side faces.

Figure 4:
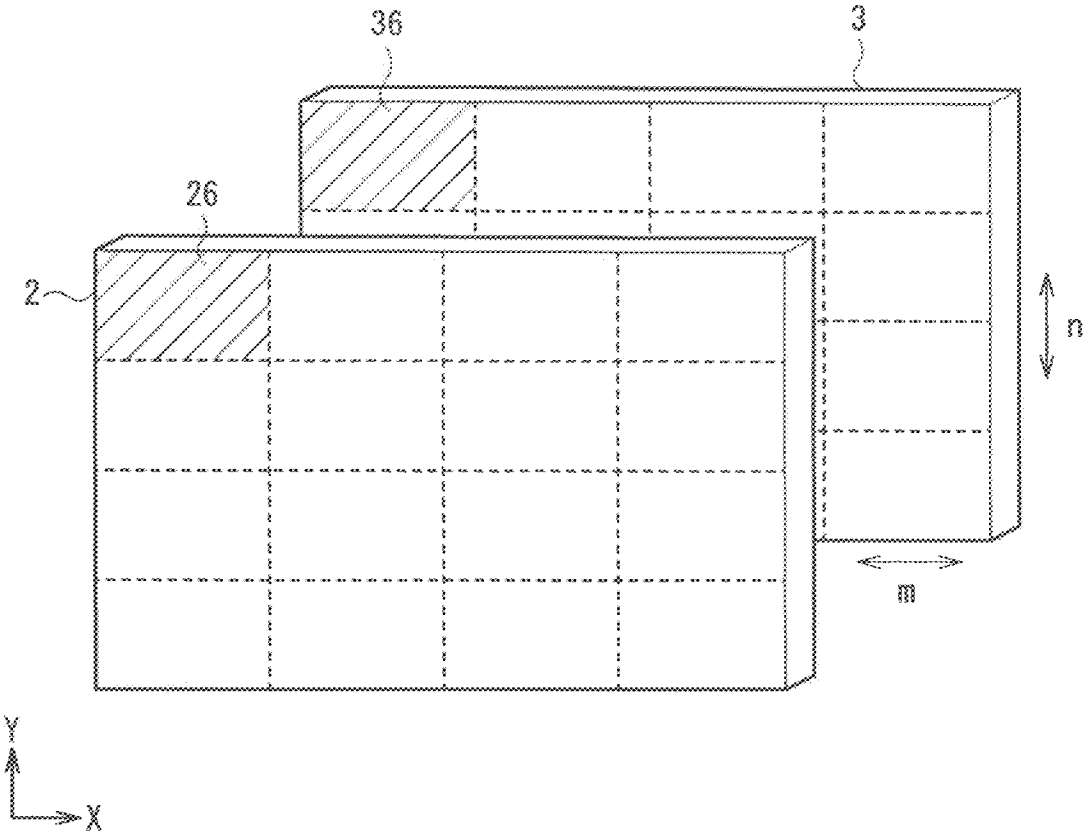
FIG. 4 is an exploded perspective view schematically illustrating an example of emission sub-regions and irradiation sub-regions in the liquid crystal display device illustrated in FIG. 1.

With this configuration, the backlight 3 is so configured that a plurality of emission sub-regions 36 (emission sub-sections), which are independently controllable of each other, are formed on the light-exit plane of the light-guide plate 30, as illustrated in FIGS. 3A to 4, for example. In other words, the backlight 3 is an edge-light backlight of a partitioning-drive type, capable of performing a partitioned-emission operation. In the light-exit plane of the backlight 3, a light-emission region is divided or partitioned into K-number of emission sub-regions 36 (vertical n×horizontal m=K, where n and m are each an integer of 2 or more) in an in-plane direction. The number of division or partition of the light-emission region is less than the number of the pixels 20 in the liquid crystal display panel 2 described above, i.e., the number of division or partition is less or lower in resolution as compared with the pixels 20. Also, as illustrated in FIG. 4, the liquid crystal display panel 2 is so configured that a plurality of irradiation sub-regions 26 corresponding to the respective emission sub-regions 36 are formed.

As illustrated in FIG. 3B, for example, the backlight 3 is also so configured that the emission sub-region 36 is formed by: at least one of the plurality of light sources 31 arranged on the side faces extending in the X-axis direction in the light-guide plate 30; and at least one of the plurality of light sources 32 arranged on the side faces extending in the Y-axis direction in the light-guide plate 30. In other words, the light source 31 on the side face in the X-axis direction and the light source 32 on the side face in the Y-axis direction emit concurrently to form the emission sub-region 36. A method of forming the emission sub-region 36 using both the light source 31 and the light source 32 will be described later in greater detail.

The backlight 3 is capable of performing independent light-emission control for each of the emission sub-regions 36 in accordance with the contents of the input picture signal Din (i.e., a picture pattern). Each of the light sources 31 and 32 in the backlight 3 may have a configuration in which a red LED for emitting red light, a green LED for emitting green light, and a blue LED for emitting blue light are combined, for example, although kinds of LED used as the light source are not limited thereto. For example, each of the light sources 31 and 32 may use a white LED which emits white light, for example. Hence, the light sources 31 and 32 each have a configuration in which one or more light sources described above is used.

The picture signal processing section 41 performs, for example, a predetermined image process for achieving higher image quality (such as a sharpness process and a gamma correction process, for example) on the input picture signal Din configured of the pixel signals of the respective pixels 20, to thereby generate the picture signal D1. It is to be noted that the picture signal D1 thus generated is also configured by the pixel signals of the respective pixels 20 as with the input picture signal Din.

The partitioning-drive processing section 42 performs a predetermined partitioning-drive process on the picture signal D1 supplied from the picture signal processing section 41. Thereby, the partitioning-drive processing section 42 generates: an emission pattern signal BL1 representing a light emission pattern of the emission sub-regions 36 in the backlight 3; and a partitioning-drive picture signal D4. The partitioning-drive processing section 42 so generates the emission pattern signal BL1 and the partitioning-drive picture signal D4 that the light source 31 on the side face in the X-axis direction in the light-guide plate 30 and the light source 32 on the side face in the Y-axis direction in the light-guide plate 30 emit concurrently, and that the partitioned-emission operation is thereby performed. A detailed configuration of the partitioning-drive processing section 42 will be described later with reference to FIG. 5.

The timing controlling section 43 controls drive timing of each of the backlight driving section 50, the gate driver 52, and the data driver 51, and serves to supply the partitioning-drive picture signal D4, supplied from the partitioning-drive processing section 42, to the data driver 51.

The gate driver 52 line-sequentially drives each of the pixels 20 in the liquid crystal display panel 2 along the gate lines G described above, in accordance with the timing control of the timing controlling section 43. The data driver 51 supplies the picture voltage, which is based on the partitioning-drive picture signal D4 supplied from the timing controlling section 43, to each of the pixels 20 in the liquid crystal display panel 2. The data driver 51 applies a digital-to-analog (D/A) conversion to the partitioning-drive picture signal D4 to generate a picture signal (the picture voltage described above) which is an analog signal, and outputs the thus-generated picture signal to each of the pixels 20. In this manner, the display-drive based on the partitioning-drive picture signal D4 is performed on each of the pixels 20 in the liquid crystal display panel 2.

In accordance with the timing control of the timing controlling section 43, the backlight driving section 50 performs the light-emission drive (lighting drive), which is based on the emission pattern signal BL1 outputted from the partitioning-drive processing section 42, on each of the light sources 31 and 32 (i.e., on the respective emission sub-regions 36) in the backlight 3.

[Detailed Configuration of Partitioning-Drive Processing Section 42]

Figure 5:
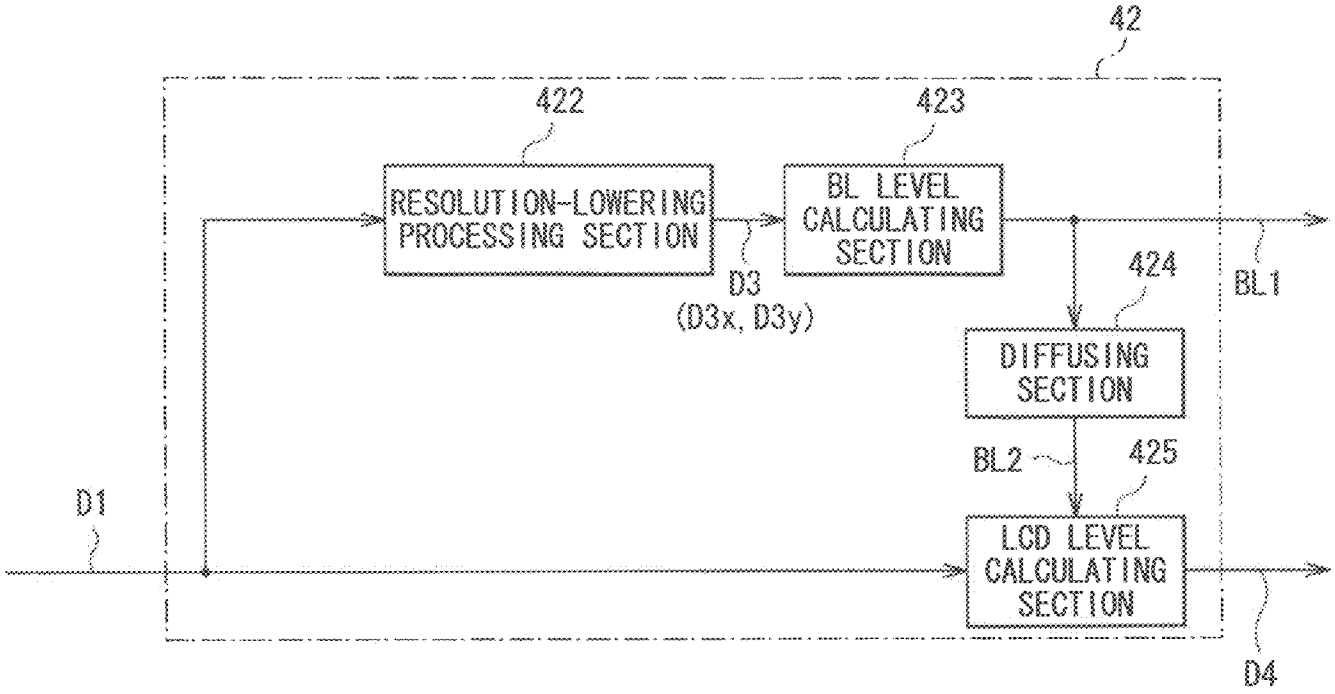
FIG. 5 is a block diagram illustrating a detailed configuration of a partitioning-drive processing section illustrated in FIG. 1.

The detailed configuration of the partitioning-drive processing section 42 will now be described with reference to FIG. 5. FIG. 5 illustrates a block configuration of the partitioning-drive processing section 42. The partitioning-drive processing section 42 is provided with a resolution-lowering processing section 422, a BL level calculating section 423, a diffusing section 424, and an LCD level calculating section 425.

The resolution-lowering processing section 422 performs a predetermined resolution-lowering process on the picture signal D1, to thereby generate a picture signal D3 on which the emission pattern signal BL1 described above is based. The resolution-lowering processing section 422 reconstructs a picture signal D2, configured of a luminance level signal (the pixel signal) on a pixel 20 scale, to a luminance level signal on the emission sub-region 36 scale which is lower in resolution as compared with the pixels 20, to thereby generate the picture signal D3. In performing the reconstruction, the resolution-lowering processing section 422 extracts, in a later-described characteristic amount extracting section (characteristic amount extracting sections 422A and 422B), a predetermined characteristic amount (such as, but not limited to, a maximum value of a luminance level, a mean value of the luminance level, and a synthetic value thereof) from the plurality of pixel signals in the respective emission sub-regions 36.

More specifically, in performing the reconstruction, the resolution-lowering processing section 422 generates a picture signal D3*x* (a first resolution-lowering signal) based on the picture signal D1, on the assumption that only the light sources 31 are to be used to form the plurality of emission sub-regions 36 (a plurality of first virtual emission subsections) which are arrayed along the X-axis direction (an aligning direction of the light sources 31). Further, the resolution-lowering processing section 422 generates a picture signal D3*y* (a second resolution-lowering signal) based on the picture signal D1, on the assumption that only the light sources 32 are to be used to form the plurality of emission sub-regions 36 (a plurality of second virtual emission subsections) which are arrayed along the Y-axis direction (an aligning direction of the light sources 32). In other words, the picture signal D3 described above is configured by the picture signals D3*x* and D3*y*. A detailed operation of the resolution-lowering processing section 422 will be described later.

The BL level calculating section 423 calculates, based on the picture signal D3 (the picture signals D3*x* and D3*y*) as the luminance level signal on the emission sub-region 36 scale, an emission luminance level of each of the emission sub-regions 36, to thereby generate the emission pattern signal BL1 which represents the light emission pattern of the emission sub-regions 36. More specifically, the BL level calculating section 423 analyzes the luminance level of the picture signal D3 for each of the emission sub-regions 36, to thereby obtain the light emission patterns corresponding to the luminance levels of the respective regions. In particular, according to this embodiment, the BL level calculating section 423 uses both the two kinds of picture signals D3*x* and D3*y* described above to generate the emission pattern signal BL1 (emission pattern signals BL1*x* in the X-axis direction and BL1*y* in the Y-axis direction).

The diffusing section 424 performs a predetermined diffusion process on the emission pattern signal BL1 outputted from the BL level calculating section 423, and outputs an emission pattern signal BL2 subjected to the diffusion process to the LCD level calculating section 425, in which diffusion section 424 a conversion from a signal on the emission sub-region 36 scale to a signal on the pixel 20 scale is performed. The diffusion process is performed with taking into consideration a luminance distribution (a diffusion distribution of light from the light sources) in the actual light sources 31 and 32 in the backlight 3.

The LCD level calculating section 425 generates, based on the picture signal D1 and the emission pattern signal BL2 applied with the diffusion process, the partitioning-drive picture signal D4. In one embodiment, the LCD level calculating section 425 generates the partitioning-drive picture signal D4 by dividing a signal level of the picture signal D1 by the emission pattern signal BL2 applied with the diffusion process. In more detail, the LCD level calculating section 425 may generate the partitioning-drive picture signal D4 using Equation (1) below.

$$D4=(D1/BL2) \qquad \text{Equation (1)}$$

Herein, the following relationship is obtained from the Equation (1) above.

Original signal(picture signal $D1$)=(emission pattern signal $BL2$×partitioning-drive picture signal $D4$)

In this relationship, a physical meaning of "(emission pattern signal BL2×partitioning-drive picture signal D4)" is that images (an emission plane image) of the respective emission sub-regions 36 in the backlight 3, lighted according to a certain light emission pattern, are overlapped with or superimposed by images (a panel plane image) by the partitioning-drive picture signal D4. This allows a contrast distribution of transmission light in the liquid crystal display panel 2 to be cancelled, making it equivalent to the fact that an original display (displaying by the original signal) is seen visually.

[Operation and Effect of Liquid Crystal Display Device 1]

An effect and an operation of the liquid crystal display device 1 according to this embodiment will now be described.

[1. Outline of Partitioned-Emission Operation]

First, in the liquid crystal display device 1, the picture signal processing section 41 performs the predetermined image process on the input picture signal Din, to thereby generate the picture signal D1, as illustrated in FIG. 1. Then, the partitioning-drive processing section 42 performs the predetermined partitioning-drive process on the picture signal D1. Thereby, the emission pattern signal BL1 representing the light emission pattern of the emission sub-regions 36 in the backlight 3 and the partitioning-drive picture signal D4 are generated.

Then, the partitioning-drive picture signal D4 and the emission pattern signal BL1 thus generated are inputted to the timing controlling section 43. Of these signals, the partitioning-drive picture signal D4 is supplied from the timing controlling section 43 to the data driver 51. The data driver 51 applies the D/A conversion to the partitioning-drive picture signal D4, and generates the picture voltage which is the analog signal. Then, a display-drive operation is performed using drive voltages outputted from the gate driver 52 and the data driver 51 and supplied to the respective pixels 20. Thereby, the display-drive based on the partitioning-drive picture signal D4 is performed on each of the pixels 20 in the liquid crystal display panel 2.

More specifically, as illustrated in FIG. 2, an operation of the TFT element 21 is switched over between ON and OFF in accordance with a selection signal supplied through the gate line G from the gate driver 52. Thereby, the conduction is selectively performed between the data line D and the liquid crystal element 22 in addition to the auxiliary capacitor 23. As a result, the picture voltage based on the partitioning-drive picture signal D4, supplied from the data driver 51, is supplied to the liquid crystal element 22, and thus the display-drive operation is performed in a line-sequential fashion.

On the other hand, the emission pattern signal BL1 is supplied from the timing controlling section 43 to the backlight driving section 50. The backlight driving section 50 performs, based on the emission pattern signal BL1, the light-emission drive (the partitioning-drive operation) on each of the light sources 31 and 32 in the backlight 3. Thereby, in the backlight 3, the plurality of emission sub-regions 36, which are independently controllable of each other, are formed on the light-exit plane by the plurality of light sources 31 and 32 disposed on the side faces of the light-guide plate 30.

Herein, in the pixel 20 to which the picture voltage is supplied, illumination light from the backlight 3 is modulated in the liquid crystal display panel 2, and the thus-modulated light exits therefrom as display light. Thereby, the picture-displaying based on the input picture signal Din is performed in the liquid crystal display device 1.

Figure 6:
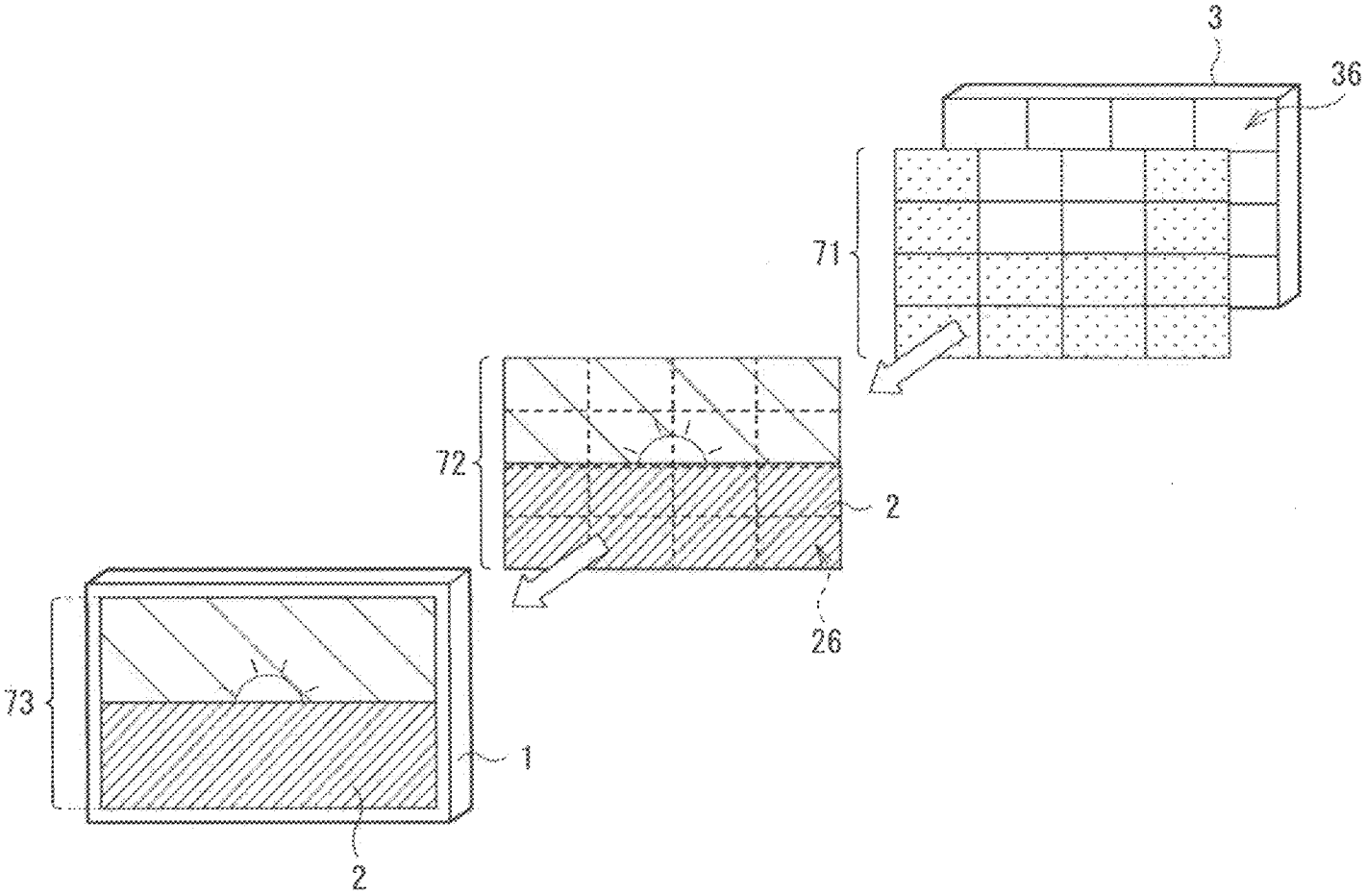
FIG. 6 schematically illustrates an outline of a partitioned-emission operation of the backlight in the liquid crystal display device illustrated in FIG. 1.

More specifically, a synthesized image 73, in which an emission plane image 71 based on each of the emission sub-regions 36 of the backlight 3 and a panel plane image 72 based on the liquid crystal display panel 2 alone are physically superimposed (or synthesized in a multiplicative fashion), becomes the image finally viewed in the liquid crystal display device 1 as a whole, as illustrated in FIG. 6, for example.

[2. Partitioned-Emission Operation Adapted to Edge-Light Backlight]

The partitioned-emission operation adapted to the backlight 3 of the edge-light type, which is one of features of the technology, will now be described in detail in comparison to comparative examples, with reference to FIGS. 7 to 12.

[2-1. Partitioned-Emission Operation of Comparative Examples]

Figure 7:
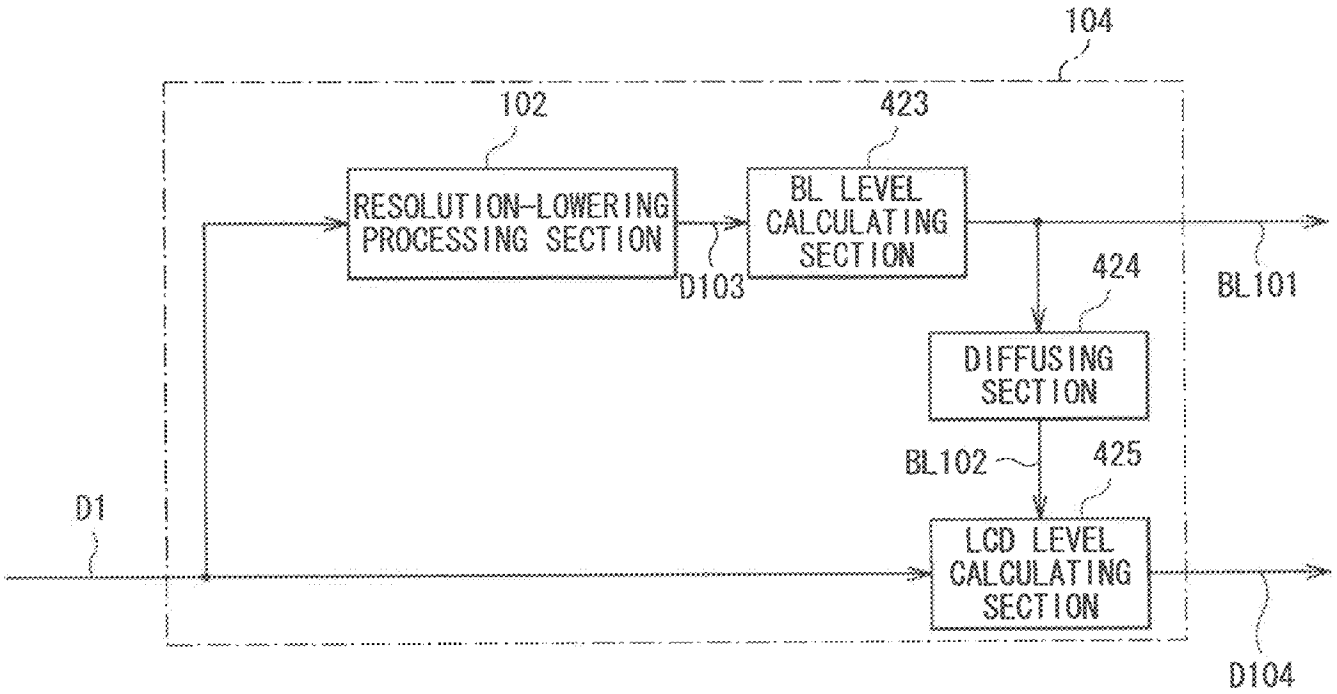
FIG. 7 is a block diagram illustrating a configuration of a partitioning-drive processing section in each liquid crystal display device according to first to third comparative examples.

FIG. 7 illustrates a block configuration of a partitioning-drive processing section (a partitioning-drive processing section 104) in a liquid crystal display device according to a comparative example (first to third comparative examples). The partitioning-drive processing section 104 according to each of the first to the third comparative examples is provided with a resolution-lowering processing section 102 described below, instead of the resolution-lowering processing section 422 in the partitioning-drive processing section 42 according to the embodiment illustrated in FIG. 5. In other words, these comparative examples each correspond to an example where an existing partitioned-emission operation in a currently-available backlight is applied as it is to a liquid crystal display device utilizing an edge-light backlight.

In the partitioning-drive processing section 104, first, the resolution-lowering processing section 102 performs a predetermined resolution-lowering process described below on the picture signal D1, to thereby generate a picture signal D103. Then, the BL level calculating section 423 generates, based on the picture signal D103, an emission pattern signal BL101 which represents the light emission pattern of the emission sub-regions 36. Also, the diffusing section 424 performs a diffusion process on the emission pattern signal BL101 outputted from the BL level calculating section 423, and outputs an emission pattern signal BL102 subjected to the diffusion process to the LCD level calculating section 425. Then, the LCD level calculating section 425 generates, based on the picture signal D1 and the emission pattern signal BL102 applied with the diffusion process, a partitioning-drive picture signal D104. More specifically, the LCD level calculating section 425 generates, in a similar manner as in the embodiment, the partitioning-drive picture signal D104 using Equation (2) below.

$$D104=(D1/BL102) \quad \text{Equation (2)}$$

Comparative Examples 1 to 3

Figure 8A:
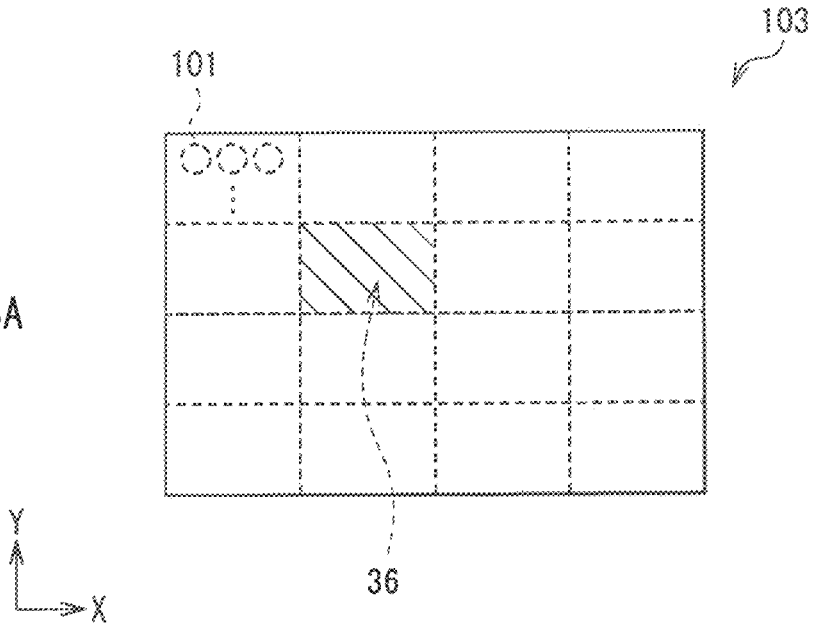
FIGS. 8A and 8B schematically illustrate an example of a partitioned-emission operation in a backlight according to the first comparative example.
Figure 8B:
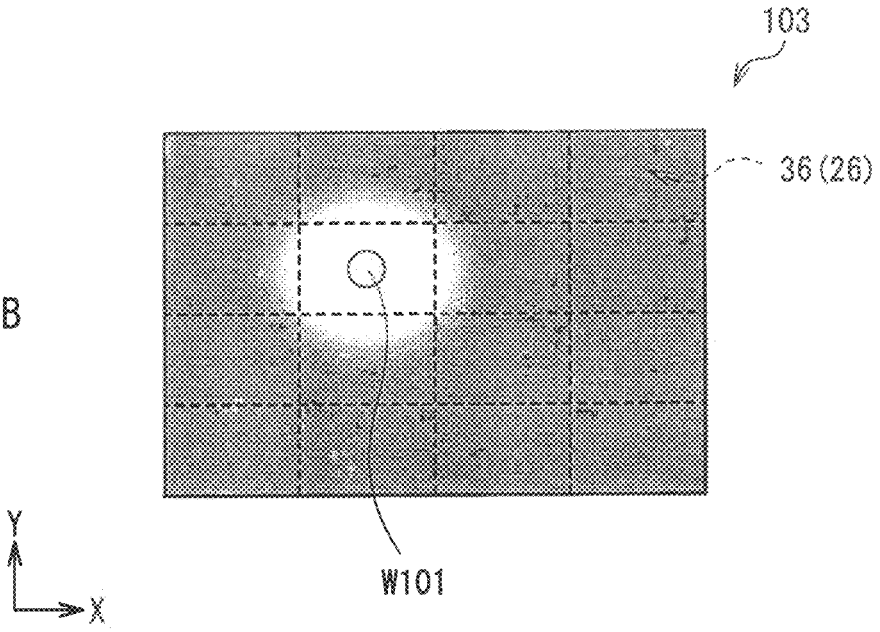

The first comparative example illustrated in FIGS. 8A and 8B has a configuration in which a backlight 103 is of a so-called direct backlight or an "overhead" backlight as illustrated, for example, in FIG. 8A, unlike the backlight 3 according to the embodiment. In other words, a light source 101 is disposed in each of the emission sub-regions 36 in the light-exit plane. Hence, as illustrated, for example, in FIG. 8B, only the light sources 101 in the to-be-emitted emission sub-region 36 emit light in performing a partitioned-emission operation according to the first comparative example. The example illustrated in FIG. 8B is a case where there is a static picture, in which one small bright object (donated by W101 in the figure) is present in a generally dark background (in a gray-level background), so that only the light sources 101 in the emission sub-region 36 corresponding to pixel locations of the object emit light.

Figure 9A:
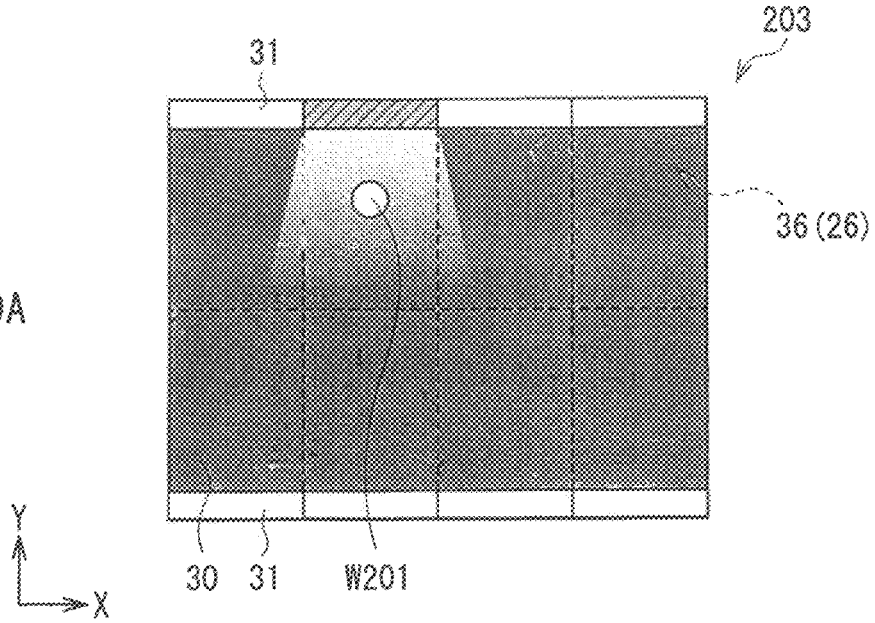
FIGS. 9A and 9B schematically illustrate examples of partitioned-emission operations in backlights according to the second and the third comparative examples.
Figure 9B:
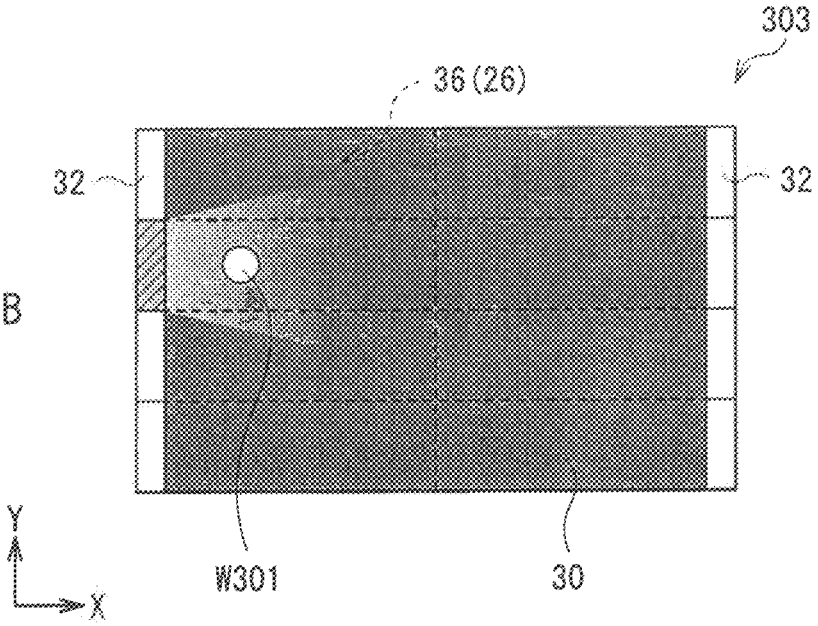

On the other hand, in the second comparative example illustrated in FIG. 9A and the third comparative example illustrated in FIG. 9B, backlights 203 and 303 are each of the so-called edge-light type, as in the backlight 3 according to the embodiment. However, unlike the backlight 3 according to the embodiment illustrated in FIG. 3, the backlight 203 according to the second comparative example illustrated in FIG. 9A has a configuration in which only the light sources 31, which are on the side faces extending in the X-axis direction in the light-guide plate 30, are disposed. In the backlight 303 according to the third comparative example illustrated in FIG. 9B, only the light sources 32, which are on the side faces extending in the Y-axis direction in the light-guide plate 30, are disposed.

In each of the second and the third comparative examples, only the light sources 31 or the light sources 32 corresponding to the to-be-emitted emission sub-region 36 emit light as illustrated, for example, in FIGS. 9A and 9B in performing a partitioned-emission operation, as in the first comparative example described above. In the second comparative example, only the light source 31 (the light source 31 shaded in the figure) for forming the emission sub-region 36 corresponding to pixel locations of an object denoted by W201 emits light. Likewise, in the third comparative example, only the light source 31 (the light source 31 shaded in the figure) for forming the emission sub-region 36 corresponding to pixel locations of an object denoted by W301 emits light.

Herein, the resolution-lowering processing section 102 illustrated in FIG. 7 performs the predetermined resolution-lowering process in a manner described below on the picture signal D1 in performing the partitioned-emission operation in each of such first to third comparative examples, to thereby generate the picture signal D103.

Figure 10A:
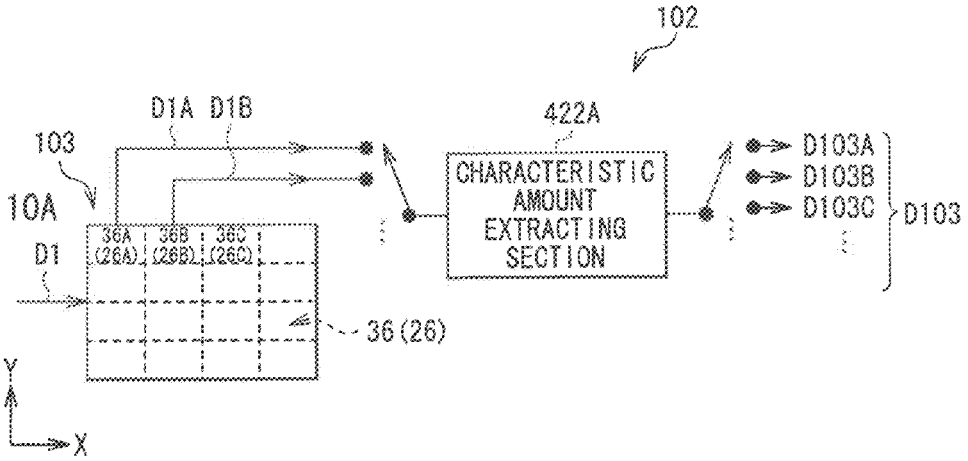
FIGS. 10A to 10C schematically illustrate respectively an example of an operation of generating a resolution-lowering signal in the partitioned-emission operation according to the first to the third comparative examples.

In the first comparative example, the characteristic amount extracting section 422A extracts the predetermined characteristic amounts from the plurality of pixel signals (picture signals D1A, D1B, etc.) in the picture signal D1 within each of the emission sub-regions 36 (emission sub-regions 36A, 36B, 36C, etc.), as illustrated, for example, in FIG. 10A. The predetermined characteristic amount may be a maximum value of a luminance level, a mean value of the luminance level, or a synthetic value thereof, for example. In more detail, the characteristic amount extracting section 422A extracts the characteristic amount from each of the pixel signals D1A in the emission sub-region 36A (the irradiation sub-region region 26A), to thereby generate a picture signal D103A serving as a resolution-lowering signal. Likewise, the characteristic amount extracting section 422A extracts individually the characteristic amounts from the respective pixel signals D1B, D1C, etc. in the emission sub-regions 36B, 36C, etc. (the irradiation sub-regions 26B, 26C, etc.), to thereby generate picture signals D103B, D103C, etc. serving as the resolution-lowering signals, respectively. Thus, picture signals D103A, D103B, D103C, etc. corresponding to the respective emission sub-regions 36 that are to be actually used, are generated in the resolution-lowering processing section 102, and are outputted as the picture signal D103.

Figure 10B:
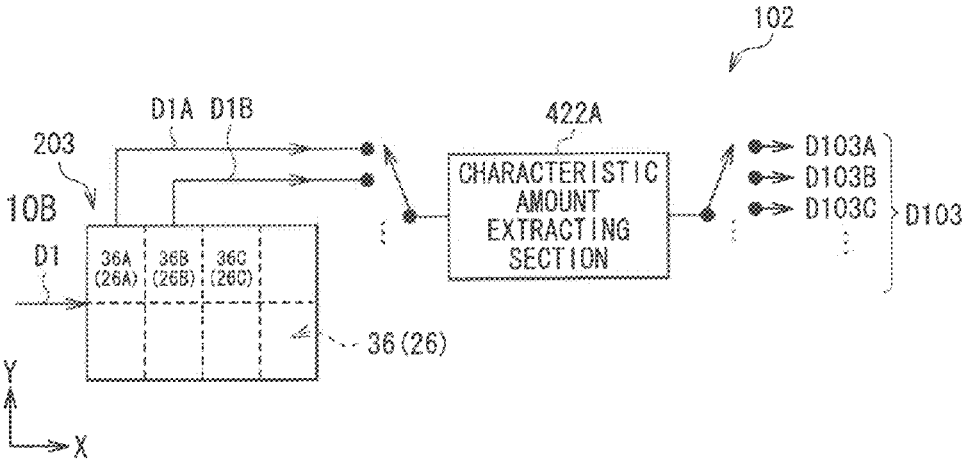

Likewise, in the second comparative example, the characteristic amount extracting section 422A extracts the predetermined characteristic amounts from the plurality of pixel signals (the picture signals D1A, D1B, etc.) in the picture signal D1 within each of the emission sub-regions 36 (the emission sub-regions 36A, 36B, 36C, etc.), as illustrated, for example, in FIG. 10B. Thereby, in the second comparative example as well, the picture signals D103A, D103B, D103C, etc. corresponding to the respective emission sub-regions 36 that are to be actually used, are generated in the resolution-lowering processing section 102, and are outputted as the picture signal D103.

Figure 10C:
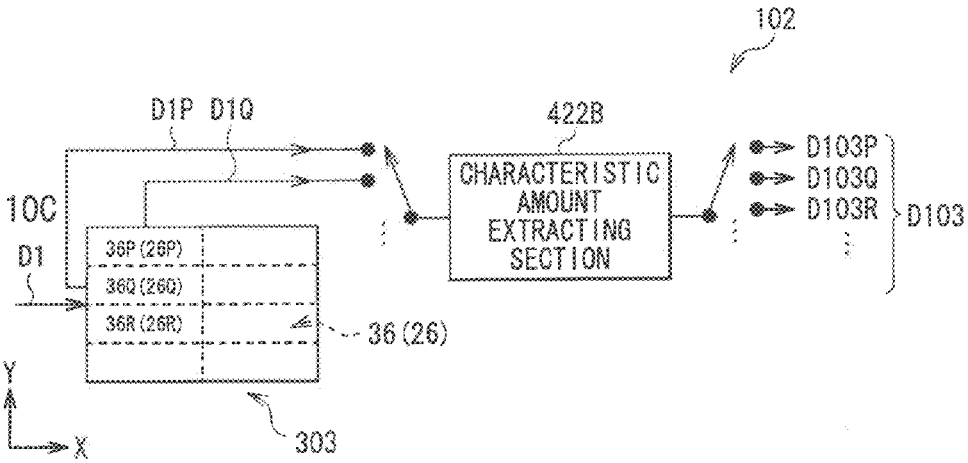

In the third comparative example, basically likewise, the characteristic amount extracting section 422B extracts the predetermined characteristic amounts from the plurality of pixel signals (picture signals D1P, D1Q, etc.) in the picture signal D1 within each of the emission sub-regions 36 (emission sub-regions 36P, 36Q, 36R, etc.), as illustrated, for example, in FIG. 10C. In more detail, the characteristic amount extracting section 422B extracts the characteristic amount from each of the pixel signals D1P in the emission sub-region 36P (irradiation sub-region region 26P), to thereby generate a picture signal D103P serving as a resolution-lowering signal. Likewise, the characteristic amount extracting section 422B extracts individually the characteristic amounts from the respective pixel signals D1Q, D1R, etc. in the emission sub-regions 36Q, 36R, etc. (irradiation sub-regions 26Q, 26R, etc.), to thereby generate picture signals D103Q, D103R, etc. serving as the resolution-lowering signals, respectively. Thereby, in the third comparative example as well, the picture signals D103P, D103Q, D103R, etc. corresponding to the respective emission sub-regions 36 that are to be actually used, are generated in the resolution-lowering processing section 102, and are outputted as the picture signal D103.

However, in the partitioned-emission operation in each of the first to the third comparative examples, only the picture signals corresponding to the respective emission sub-regions 36 that are to be actually used are generated in the resolution-lowering processing section 102, and are outputted as the picture signal D103 as described above. In other words, as illustrated in FIGS. 8B, 9A, and 9B, only the light sources (the light sources 101, the light sources 31, or the light sources 32) for forming the emission sub-region 36 corresponding to the pixel locations of the object (bright object) emit light.

Hence, when the backlight 203 or 303 of the edge-light type as in the second or the third comparative example is employed for the purpose of making the backlight thinner than the backlight 103 of the direct-type of the first comparative example, a reduction of luminance is generated in the light-exit plane in accordance with a distance from the light source 31 or 32 in performing the partitioned-emission operation. For example, as compared with a position near the light source 31 or 32, light-emission intensity is lower near the center of the light-exit plane and on an opposed side thereof that are located away from the light source 31 or 32 (i.e., the light-emission intensity is gradually decreased with increasing distance from the light source 31 or 32), since in the second and the third comparative examples, only the light source 31 or 32 disposed on one side face corresponding to each of the emission sub-regions 36 emits light to form the emission sub-region 36, as illustrated in FIGS. 9A and 9B. Such a reduction in the luminance corresponding to the distance from the light source 31 or 32 causes display luminance non-uniformity in a display screen, incurring a decrease in displaying quality.

[2-2. Partitioned-Emission Operation of the Embodiment]

In contrast, the partitioning-drive processing section 42 according to the embodiment so generates the emission pattern signal BL1 and the partitioning-drive picture signal D4 that the partitioned-emission operation is performed as follows in the backlight 3 of the edge light type, as illustrated, for example, in FIG. 11. In other words, the light source 31 on the side face in the X-axis direction in the light-guide plate 30 and the light source 32 on the side face in the Y-axis direction in the light-guide plate 30 emit concurrently to thereby perform the partitioned-emission operation. In this embodiment, the light source 31A on the side face in the X-axis direction and the light source 32A on the side face in the Y-axis direction emit concurrently in forming the emission sub-region 36 corresponding to pixel locations of an object denoted by W1, for example. In the following, the partitioned-emission operation according to the embodiment will be described in detail.

Figure 12:
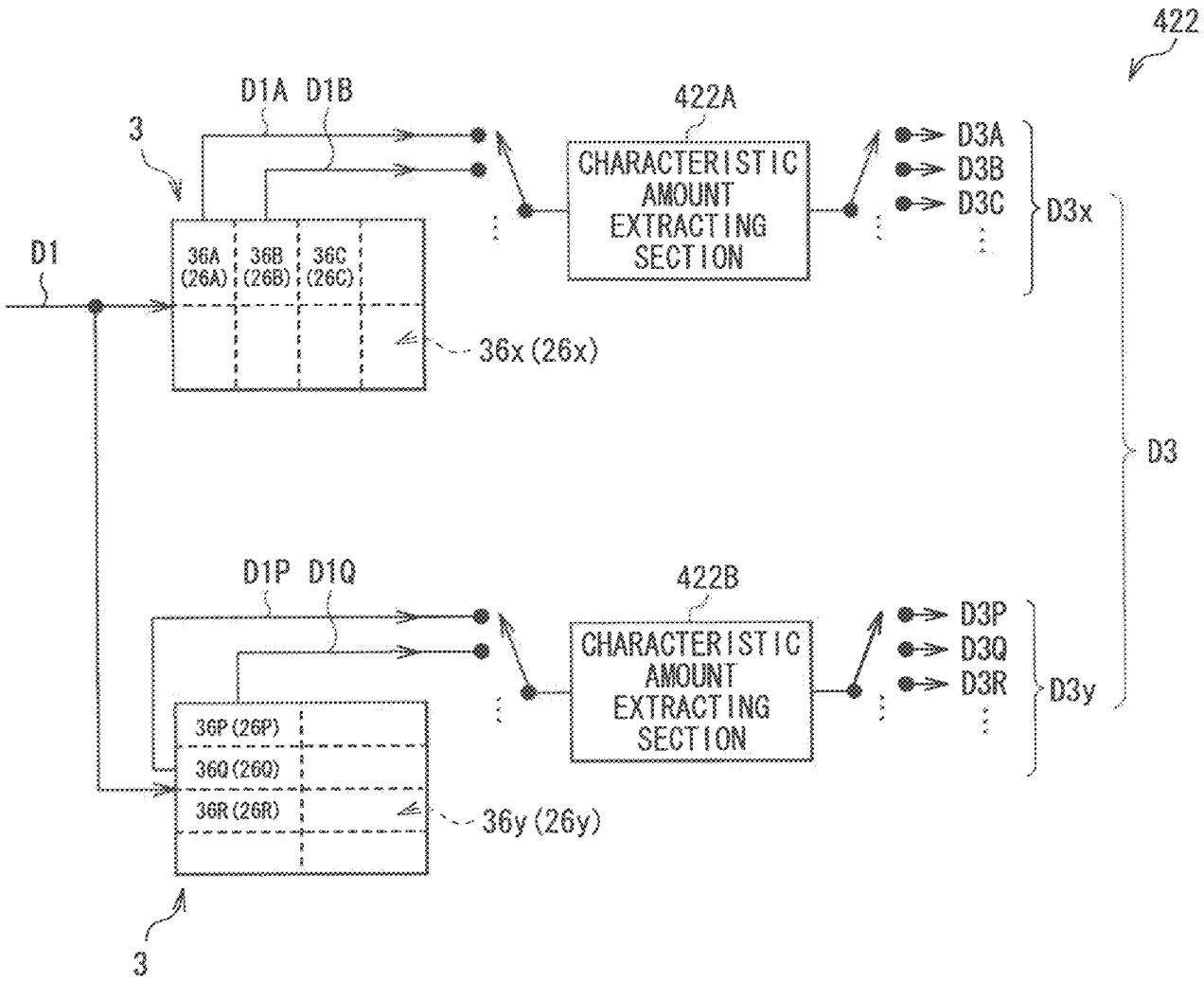
FIG. 12 schematically illustrates an example of an operation of generating a resolution-lowering signal in the partitioned-emission operation according to the embodiment.

In this embodiment, the resolution-lowering processing section 422 in the partitioning-drive processing section 42 performs the resolution-lowering process on the picture signal D1 in a manner described, for example, in FIG. 12, to thereby generate the picture signal D3 (the picture signals D3*x* and D3*y*).

More specifically, first, the resolution-lowering processing section 422 generates the picture signal D3*x* based on the picture signal D1, on the assumption that only the light sources 31 are to be used to form the plurality of (virtual) emission sub-regions 36 (the emission sub-regions 36A, 36B, 36C, etc.) which are arrayed along the X-axis direction (the aligning direction of the light sources 31). In more detail, the characteristic amount extracting section 422A extracts the characteristic amount from each of the pixel signals D1A in the emission sub-region 36A (the irradiation sub-region region 26A), to thereby generate a picture signal D3A serving as the resolution-lowering signal. Likewise, the characteristic amount extracting section 422A extracts individually the characteristic amounts from the respective pixel signals D1B, D1C, etc. in the emission sub-regions 36B, 36C, etc. (the irradiation sub-regions 26B, 26C, etc.), to thereby generate picture signals D3B, D3C, etc. serving as the resolution-lowering signals, respectively. Hence, the picture signals D3A, D3B, D3C, etc., corresponding to the virtual emission sub-regions 36A, 36B, 36C, etc., are generated in the resolution-lowering processing section 422, which are outputted as the picture signal D3*x* (for the light sources 31 on the side faces in the X-axis direction).

In parallel therewith, the resolution-lowering processing section 422 also generates the picture signal D3*y* based on the picture signal D1, on the assumption that only the light sources 32 are to be used to form the plurality of (virtual) emission sub-regions 36 (the emission sub-regions 36P, 36Q, 36R, etc.) which are arrayed along the Y-axis direction (the aligning direction of the light sources 32). In more detail, the characteristic amount extracting section 422B extracts the characteristic amount from each of the pixel signals D1P in the emission sub-region 36P (the irradiation sub-region region 26P), to thereby generate a picture signal D3P serving as the resolution-lowering signal. Likewise, the characteristic amount extracting section 422B extracts individually the characteristic amounts from the respective pixel signals D1Q, D1R, etc. in the emission sub-regions 36Q, 36R, etc. (the irradiation sub-regions 26Q, 26R, etc.), to thereby generate picture signals D3Q, D3R, etc. serving as the resolution-lowering signals, respectively. Hence, the picture signals D3P, D3Q, D3R, etc., corresponding to the virtual emission sub-regions 36P, 36Q, 36R, etc., are generated in the resolution-lowering processing section 422, which are outputted as the picture signal D3*y* (for the light sources 32 on the side faces in the Y-axis direction).

Then, the BL level calculating section 423 uses both the two kinds of picture signals D3*x* and D3*y* thus generated to generate the emission pattern signal BL1. Also, the diffusion section 424, using the emission pattern signal BL1 obtained based on the picture signals D3*x* and D3*y*, generates the emission pattern signal BL2, and the LCD level calculating section 425 generates the partitioning-drive picture signal D4. Then, the partitioned-emission operation and the displaying operation are performed, based on the emission pattern signal BL1 and the partitioning-drive picture signal D4.

Figure 11:
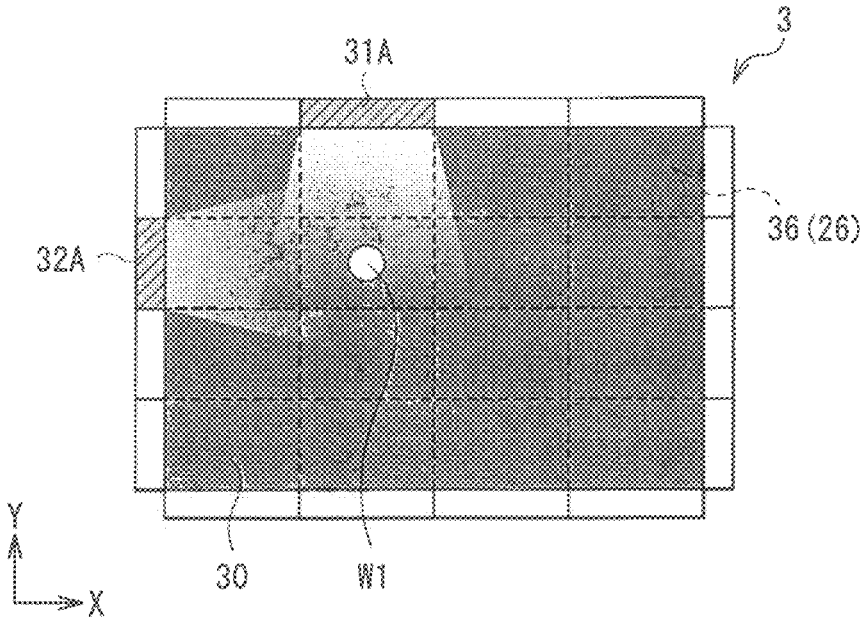
FIG. 11 schematically illustrates an example of the partitioned-emission operation in the backlight according to the embodiment.

Hence, as illustrated in FIG. 11, the partitioned-emission operation is so performed that at least one of the light sources 31 on the side faces extending in the X-axis direction in the light-guide plate 30 and at least one of the light sources 32 on the side faces extending in the Y-axis direction in the light-guide plate 30 are allowed to emit concurrently to thereby form the emission sub-regions 36, for example. Thereby, in this embodiment, the reduction of luminance corresponding to the distances from the light sources 31 and 32 in the light-exit plane is reduced in the backlight of the edge-light type, as compared with examples (the second and the third comparative examples described above) where only the light source disposed on one side face corresponding to each of the emission sub-regions 36 emits light to form the emission sub-regions 36. As a result, the display luminance non-uniformity in the display screen is suppressed.

According to this embodiment, the light-emission drive is so performed that one or more of the light sources 31 on the side faces in the X-axis direction and one or more of the light sources 32 on the side faces in the Y-axis direction within the two pairs of side faces of the light-guide plate 30 are allowed to emit light concurrently so as to form the emission sub-regions 36, in performing the picture-displaying using the backlight 3 of the edge-light type which performs the partitioned-emission operation. This makes it possible to reduce the reduction of luminance corresponding to the distances from the light sources 31 and 32 in the light-exit plane of the backlight 3, and to suppress the display luminance non-uniformity in the display screen. Therefore, it is possible to increase the displaying quality in performing the picture-displaying utilizing the backlight of the edge-light type in which the partitioned-emission operation is performed.

Also, since the display luminance non-uniformity in the display screen is suppressed as described above, it is possible to apply the partitioned-emission operation while minimizing the decrease in image quality, and to achieve lower power consumption and higher contrast, in a case where a size of the liquid crystal display panel 2 is made larger (larger screen) in the liquid crystal display device 1 which uses the backlight 3 of the edge-light type.

[Modification]

In the following, a modification of the embodiment described above will be described. Note that the same or equivalent elements as those of the embodiment are denoted with the same reference numerals, and will not be described in detail.

Figure 13:
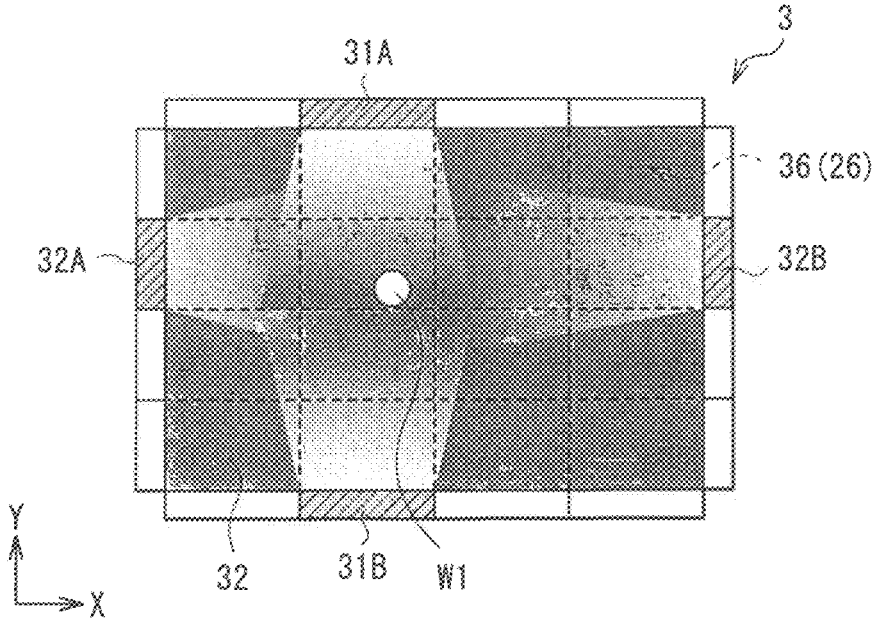
FIG. 13 schematically illustrates an example of a partitioned-emission operation in a backlight according to a modification.

FIG. 13 schematically illustrates an example of a partitioned-emission operation according to the modification. In this modification, both the light sources (the light sources 31 or the light sources 32) on a pair of opposing side faces in the light-guide plate 30 of the backlight 3 are taken into consideration to generate the picture signals D3*x* and D3*y* serving as the resolution-lowering signals. In other words, the partitioning-drive processing section 42 generates the first resolution-lowering signal with consideration of both of a pair of the first virtual emission subsections formed between the first pair of opposing side faces, and generates the second resolution-lowering signal with consideration of both of a pair of the second virtual emission subsections formed between the second pair of opposing side faces.

As illustrated in FIG. 13, in this modification, the light-emission drive is so performed in the partitioning-drive processing section 42 that the light sources 31 on the respective side faces in the X-axis direction are allowed to emit concurrently and the light sources 32 on the respective side faces in the Y-axis direction are allowed to emit concurrently so as to form the emission sub-regions 36.

Figure 14:
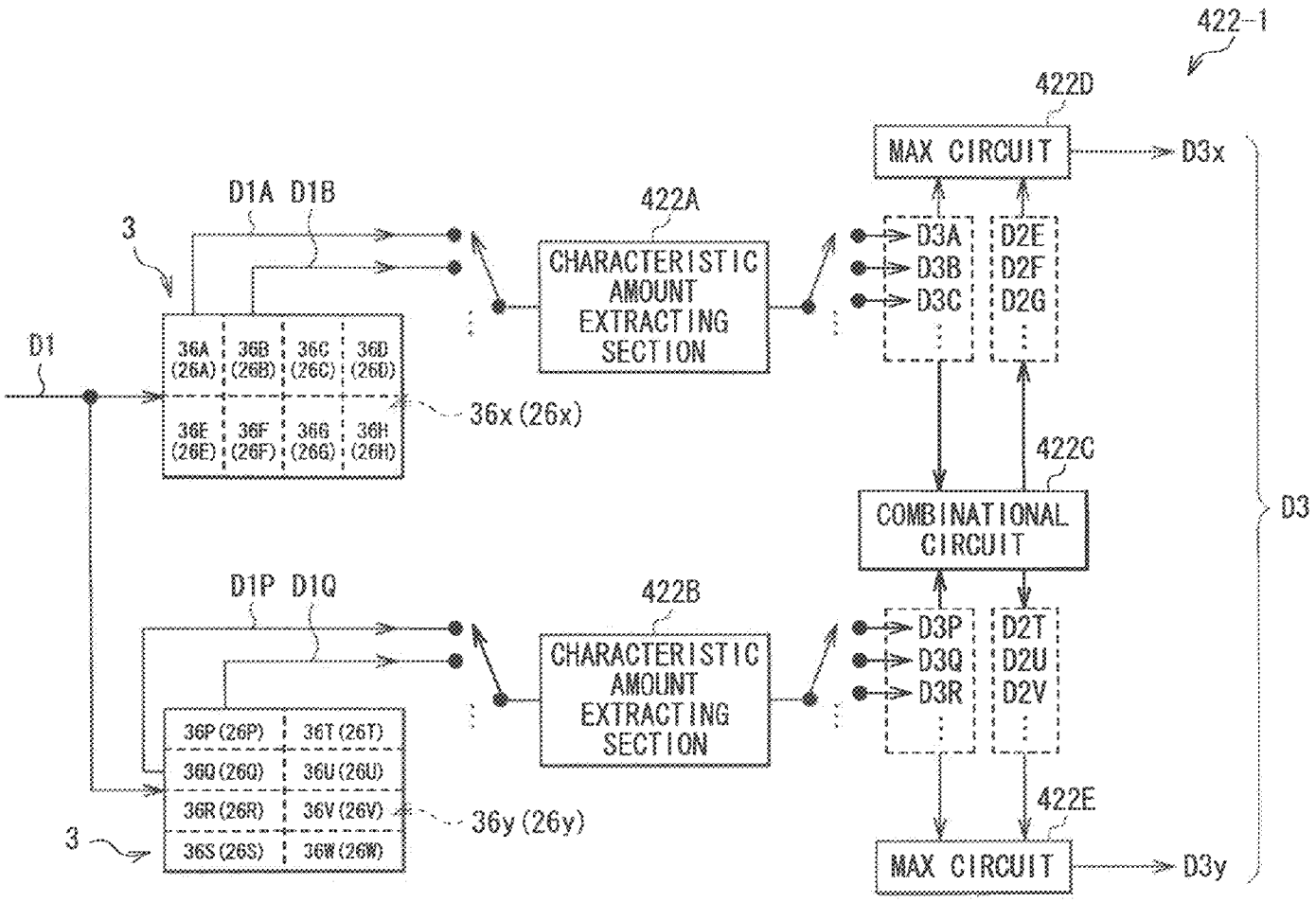
FIG. 14 schematically illustrates an example of an operation of generating a resolution-lowering signal in the partitioned-emission operation according to the modification.

More specifically, a resolution-lowering processing section 422-1 according to this modification performs the resolution-lowering process on the picture signal D1 to generate the picture signal D3 (the picture signals D3*x* and D3*y*), in a manner illustrated in FIG. 14, for example. The resolution-lowering processing section 422-1 is further provided, in the resolution-lowering processing section 422 according to the embodiment illustrated in FIG. 12, with a combinational circuit 422C and MAX circuits 422D and 422E, which are described below.

The combinational circuit 422C, based on both the picture signals D3A, D3B, D3C, etc. outputted from the characteristic amount extracting section 422A and the picture signals D3P, D3Q, D3R, etc. outputted from the characteristic amount extracting section 422B, performs a predetermined combinational logic process on those picture signals. The combinational logic process, for example, obtains a magnitude of a signal level in a position symmetrical to the X-axis and a magnitude of a signal level in a position symmetrical to the Y-axis, based on positions and magnitudes of signal levels in a screen of the picture signal D3A and the picture signal D3P. For example, the combination logic process so calculates that the signal level in the position symmetrical to the X-axis becomes larger when an intersection point of the picture signal D3A with the picture signal D3P is closer to the X-axis. On the other hand, when the intersection point of the picture signal D3A with the picture signal D3P is closer to the Y-axis, the combination logic process so calculates that the signal level in the position symmetrical to the Y-axis becomes larger, for example. Thus, picture signals D2E, D2F, D2G, etc. corresponding to emission sub-regions 36E, 36F, 36G, etc. (irradiation sub-regions 26E, 26F, 26G, etc.), which are on the opposing side of the emission sub-regions of the respective picture signals D3A, D3B, D3C, etc., are generated, respectively. Also, picture signals D2T, D2U, D2V, etc. corresponding to emission sub-regions 36T, 36U, 36V, etc. (irradiation sub-regions 26T, 26U, 26V, etc.), which are on the opposing side of the emission sub-regions of the respective picture signals D3P, D3Q, D3R, etc., are generated, respectively.

The MAX circuit 422D generates the picture signal D3*x* serving as the resolution-lowering signal, based on the picture signals D3A, D3B, D3C, etc., outputted from the characteristic amount extracting section 422A and the picture signals D2E, D2F, D2G, etc., outputted from the combinational circuit 422C. More specifically, the MAX circuit 422D compares luminance levels with a predetermined threshold individually between the picture signal D3A and the picture signal D2E, between the picture signal D3B and the picture signal D2F, and so on. Then, when one or both of the luminance levels is/are equal to or higher than the threshold, the MAX circuit 422D selects the picture signal which has the higher luminance level, and outputs the same as the picture signal D3*x*. On the other hand, when one or both of the luminance levels is/are less than the threshold described before, the MAX circuit 422D outputs both of the picture signals as the picture signal D3*x*. In this example, the pair of (upper and lower) emission sub-regions 36 (for example, the emission sub-regions 36A and 36E), which are opposed to each other across the X-axis, are lighted concurrently.

The MAX circuit 422E likewise generates the picture signal D3*y* serving as the resolution-lowering signal, based on the picture signals D3P, D3Q, D3R, etc., outputted from the characteristic amount extracting section 422B and the picture signals D2T, D2U, D2V, etc., outputted from the combinational circuit 422C. More specifically, the MAX circuit 422E compares luminance levels with a predetermined threshold individually between the picture signal D3P and the picture signal D2T, between the picture signal D3Q and the picture signal D2U, and so on. Then, when one or both of the luminance levels is/are equal to or higher than the threshold, the MAX circuit 422E selects the picture signal which has the higher luminance level, and outputs the same as the picture signal D3*y*. On the other hand, when one or both of the luminance levels is/are less than the threshold described before, the MAX circuit 422E outputs both of the picture signals as the picture signal D3*y*. In this example, the pair of (left and right) emission sub-regions 36 (for example, the emission sub-regions 36P and 36T), which are opposed to each other across the Y-axis, are lighted concurrently.

With this configuration, this modification is, in addition to the achievement of effects obtained by the embodiment described above, capable of further suppressing the display luminance non-uniformity in the display screen, making it more advantageous for achieving larger display screen.

[3. Other Modifications]

Although the technology has been described in the foregoing by way of example with reference to the embodiment and the modification, the technology is not limited thereto but may be modified in a wide variety of ways.

For example, in the embodiment and the modification described above, the backlight may include the red LED, the green LED, and the blue LED as the light sources, although it is not limited to. The backlight may include a light source which emits other color light, in addition to or instead of the red LED, the green LED, and the blue LED. In one modification where the backlight is configured by the light sources emitting color lights of four colors or more, a range of color reproducibility extends, making it possible to represent a wider variety of colors.

Figure 15A:
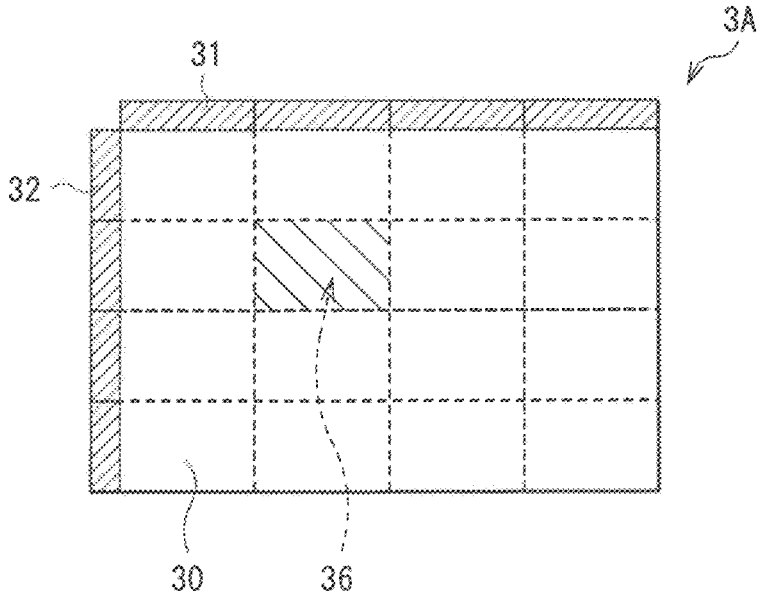
FIGS. 15A and 15B schematically illustrate an example of a partitioned-emission operation in a backlight according to another modification.
Figure 15B:
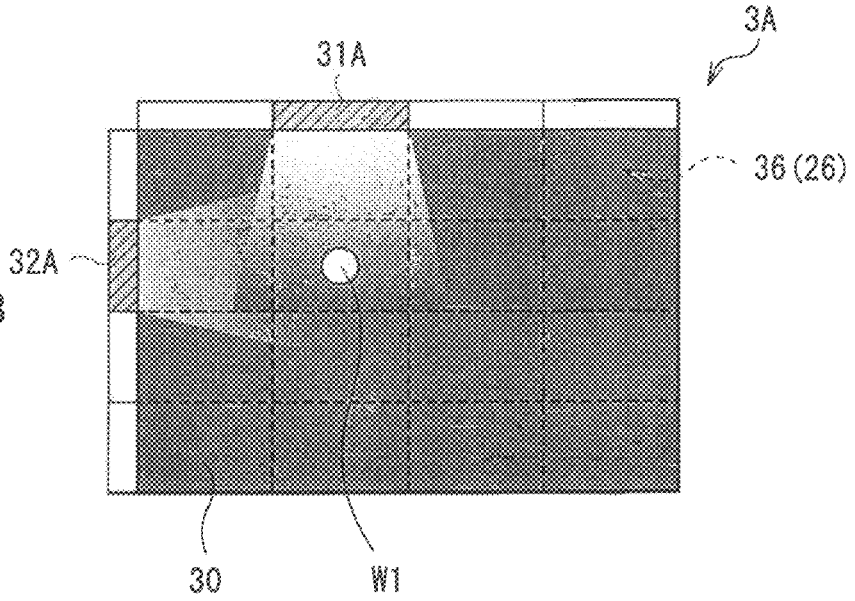

Also, in the embodiment and the modification described above, the light sources 31 may be disposed on the respective side faces extending in the X-axis direction of the light-guide plate 30, and the light sources 32 may be disposed on the respective side faces extending in the Y-axis direction of the light-guide plate 30 as illustrated in FIGS. 3A and 3B, although it is not limited thereto. In one modification, as illustrated in FIGS. 15A and 15B, a backlight 3A may have a configuration in which the light sources 31 are disposed on only one of the two side faces extending in the X-axis direction of the light-guide plate 30, and the light sources 32 are disposed on only one of the two side faces extending in the Y-axis direction of the light-guide plate 30.

Further, a series of processes in the embodiment and the modification described above may be executed by hardware or by software. When the series of processes is performed by software, a program structuring the software may be installed into a device including a general-purpose computer, for example. Such a program may be recorded in advance in a recording medium provided in a device including the computer, or may be recorded in advance in an external recording medium, for example.

Although the technology has been described in terms of exemplary embodiments, it is not limited thereto. It should be appreciated that variations may be made in the described embodiments by persons skilled in the art without departing from the scope of the technology as defined by the following claims. The limitations in the claims are to be interpreted broadly based on the language employed in the claims and not limited to examples described in this specification or during the prosecution of the application, and the examples are to be construed as non-exclusive. For example, in this disclosure, the term "preferably", "preferred" or the like is non-exclusive and means "preferably", but not limited to. The use of the terms first, second, etc. do not denote any order or importance, but rather the terms first, second, etc. are used to distinguish one element from another. Moreover, no element or component in this disclosure is intended to be dedicated to the public regardless of whether the element or component is explicitly recited in the following claims.

What is claimed is:

1. A liquid crystal display device, comprising:

a light source section including a light-guide plate having a light-exit plane partitioned into a plurality of emission subsections, a first pair of opposing edges perpendicular to the light-exit plane, and a second pair of opposing edges perpendicular to the light-exit plane, the first and second pairs of opposing edges defining an outer dimension of the light-guide plate, a plurality of first light sources disposed only along and adjacent to the first pair of opposing edges of the light-guide plate from a light-exit view, and a plurality of second light sources including more than one light source disposed only along and adjacent to the second pair of opposing edges of the light-guide plate from the light-exit view;

a liquid crystal display panel including a plurality of pixels, and configured to modulate, based on an input picture signal, light exiting from each of the emission subsections in the light source section to perform picture-displaying; and a display controlling circuit configured to generate an emission pattern signal and a partitioning-drive picture signal based on the input picture signal, the emission pattern signal representing a light emission pattern of the emission subsections in the light source section, perform, based on the emission pattern signal, light-emission drive on the light sources in the light source section, and perform, based on the partitioning-drive picture signal, display-drive on the pixels in the liquid crystal display panel, wherein the display controlling circuit performs the light-emission drive by causing one or more of the first light sources and one or more of the second light sources to emit light concurrently to form at least one emission subsection at an intersection of light from the one or more first light sources and light from the one or more second light sources.

2. The liquid crystal display device according to claim 1, wherein the display controlling circuit is further configured to:

generate, based on the input picture signal, a first resolution-lowering signal so that only the plurality of first light sources are used to form a plurality of first virtual emission subsections which are arrayed along an aligning direction of the first light sources, generate, based on the input picture signal, a second resolution-lowering signal so that only the plurality of second light sources are used to form a plurality of second virtual emission subsections which are arrayed along an aligning direction of the section light sources, and generate, based on both the first and the second resolution-lowering signals, the emission pattern signal and the partitioning-drive picture signal.

3. The liquid crystal display device according to claim 2, wherein the first light sources include more than one light source disposed adjacent to a second edge of the first pair of opposing edges, and the second light sources include more than one light source disposed adjacent to a second edge of the second pair of opposing edges, the display controlling circuit performs the light-emission drive by allowing a pair of the first opposing light sources disposed adjacent to both of the first pair of opposing edges to emit concurrently, and allowing a pair of the second opposing light sources disposed on both of the second pair of opposing edges to emit concurrently, and the display controlling circuit generates the first resolution-lowering signal based on both of a pair of the first virtual emission subsections formed between the first pair of opposing edges, and generates the second resolution-lowering signal based on both of a pair of the second virtual emission subsections formed between the second pair of opposing edges.

4. The liquid crystal display device according to claim 1, wherein the first light sources include more than one light source disposed adjacent to a second edge of the first pair of opposing edges, and the second light sources include more than one light source disposed adjacent to a second edge of the second pair of opposing edges, and the display controlling circuit performs the light-emission drive by allowing a pair of the first opposing light sources disposed adjacent to both of the first pair of opposing edges to emit concurrently, and allowing a pair of the second opposing light sources disposed adjacent to both of the second pair of opposing edges to emit concurrently.

5. The liquid crystal display device according to claim 1, wherein each of the first and the second light sources comprises a light-emitting diode.

6. The liquid crystal display device according to claim 1, wherein the plurality of first light sources and the plurality of second light sources are outside of the light exit plane of the light guide plate.

7. The liquid crystal display device according to claim 1, wherein the at least one emission subsection is spaced apart from the first and second opposing edges.

* * * * *